US007424261B2

(12) United States Patent
Uchida et al.

(10) Patent No.: US 7,424,261 B2
(45) Date of Patent: Sep. 9, 2008

(54) IMAGE HEATING APPARATUS

(75) Inventors: Hiromitsu Uchida, Toride (JP); Masahiko Yokota, Abiko (JP); Kazuhisa Okuda, Tokyo (JP); Michiaki Endo, Abiko (JP); Takatoshi Chiba, Kashiwa (JP); Shinsuke Ubayashi, Kashiwa (JP); Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 248 days.

(21) Appl. No.: 11/470,456

(22) Filed: Sep. 6, 2006

(65) Prior Publication Data

US 2007/0212133 A1 Sep. 13, 2007

(30) Foreign Application Priority Data

Sep. 13, 2005 (JP) ..... 2005-265511

(51) Int. Cl.
*G03G 15/20* (2006.01)

(52) U.S. Cl. ..... 399/329

(58) Field of Classification Search ..... 399/68, 399/163, 165, 167, 329
See application file for complete search history.

(56) References Cited

U.S. PATENT DOCUMENTS

| | | | | |
|---|---|---|---|---|
| 5,365,314 | A | 11/1994 | Okuda et al. | 355/208 |
| 5,444,521 | A | 8/1995 | Tomoyuki et al. | 355/285 |
| 5,534,987 | A | 7/1996 | Ohtsuka et al. | 355/285 |
| 5,592,276 | A | 1/1997 | Ohtsuka et al. | 339/335 |
| 5,621,510 | A | 4/1997 | Okuda et al. | 399/338 |
| 5,621,512 | A | 4/1997 | Uehara et al. | 399/328 |
| 5,669,039 | A | 9/1997 | Ohtsuka et al. | 399/68 |
| 5,852,763 | A | 12/1998 | Okuda et al. | 399/329 |
| 6,026,274 | A * | 2/2000 | Aslam et al. | 399/329 |
| 6,094,559 | A | 7/2000 | Otsuka et al. | 399/327 |
| 6,175,713 | B1 | 1/2001 | Uehara et al. | 399/307 |
| 6,195,525 | B1 | 2/2001 | Maeyama | 399/328 |
| 6,651,980 | B2 | 11/2003 | Isemura et al. | 271/259 |
| 7,383,012 | B2 * | 6/2008 | Sata | 399/329 |

FOREIGN PATENT DOCUMENTS

| | | |
|---|---|---|
| EP | 0446946 A2 | 9/1991 |
| EP | 0519454 A2 | 12/1992 |
| JP | 3-25477 | 2/1991 |
| JP | 2001-250670 | 4/1991 |
| JP | 8-262903 | 10/1996 |
| JP | 11-352804 | 12/1999 |
| JP | 2000-188177 | 7/2000 |

OTHER PUBLICATIONS

Official Letter/Extended European Search Report, issued on Dec. 28, 2006 by the European Patent Office in European Application No. 06120479.8.

* cited by examiner

*Primary Examiner*—Hoang Ngo
(74) *Attorney, Agent, or Firm*—Fitzpatrick, Cella, Harper & Scinto

(57) ABSTRACT

An image heating apparatus including an endless belt for heating an image on a recording material; a supporting member for supporting the belt; a coil for induction heat generation in the belt; control means for controlling a position of the belt in a widthwise direction by inclining the supporting member so as to maintain the position of the belt in the widthwise direction within a predetermined target range; and suppressing means for suppressing a variation of a distance between the belt and the coil with a variation of inclination of the supporting member.

5 Claims, 7 Drawing Sheets

IMAGE HEATING APPARATUS

FIELD OF THE INVENTION AND RELATED ART

The present invention relates to an image heating apparatus for heating an image on recording medium. As examples of the image heating apparatus of this type, a fixing apparatus for fixing an unfixed image formed on recording medium, a glossing apparatus for improving in glossiness an image fixed to recording medium, by heating the image, and the like.

An image forming apparatus, such as a copying apparatus and a printer, has an image formation station, and a thermal image fixing apparatus. The image forming station forms a toner image on recording medium. The thermal image fixing apparatus turns the toner image formed on recording medium into a permanent image, by thermally fixing the toner image to the recording medium.

In recent years, a method for heating a fixing member with the use of magnetic induction (Japanese Laid-open Patent Applications 11-352804 and 2000-188177) has been proposed. This method can effectively (in terms of thermal efficiency) heat the surface of an object to be heated, being therefore possible to reduce a heating member in warm-up time. There are two types of a thermal fixing apparatus based on magnetic induction: the type which is characterized in that its thermal fixing member is in the form of a roller, and the type which is characterized in that its thermal fixing member is in the form of a belt. A belt is easier to reduce in thickness than a roller which requires rigidity. Therefore, it can be reduced in the thermal capacity of its metallic heat generation layer, having therefore merit in that it can reduce the length of time for a fixing member to reach a temperature level at which fixation is possible. On the other hand, a belt has demerit in that a thermal fixing apparatus which employs an inductive thermal fixing member in the form of belt must be controlled in the position of the fixing member in terms of the width direction of the belt, that is, the direction perpendicular to the direction in which the belt is moved.

As one of the typical methods for controlling the belt position in terms of the direction parallel to the belt width, there is the belt position regulating method based on a guide, which is disclosed in Japanese Laid-open Patent Application 3-25477. This method employs a guide to prevent the deviation of the belt in the width direction of the belt; as the belt deviates, one of its edges comes into contact with the belt guide. Japanese Laid-open Patent Application 8-262903 discloses another method for controlling the belt deviation. This method is called active steering method, which controls the belt position by tilting one of the rollers with which the belt is supported by being stretched around them.

A belt position controlling method employing a guide does not require a belt position detecting means and a belt position controlling means, therefore making it possible to simplify a fixing apparatus, which in turns makes it possible to provide an inexpensive fixing apparatus. However, a belt position controlling method employing a guide is problematic for the following reason. That is, in belt position controlling method employing a guide, the belt edges come into contact with the guide. Therefore, the belt edges are likely to be damaged or buckled by the guide. Therefore, it has been rather difficult to substantially extend the life of a thermal fixing apparatus which employs a combination of a fixation belt and a belt guide. In particular, as the belt is increased in rotational speed, the speed at which the belt moves in its width direction increases in proportion to the amount of the increase in the rotational speed of the belt, increasing thereby the amount of the force to which the belt edges and belt regulating guides are subjected. Therefore, it is more difficult to substantially increase the life of a high speed thermal fixing apparatus which employs a combination of a fixation belt and a belt guide.

In the case of an active steering method, the belt edges are not subjected to force. Therefore, the problem that the edge portions of the fixation belt are damaged or buckled does not occur. Therefore, it is possible to extend the life of a fixing apparatus which employs a combination of a fixation belt and an active steering method.

However, if an active steering method, which controls the belt position by tilting one of the rollers around which the fixation belt is stretched, is employed by a thermal fixing apparatus employing a fixation belt heated by thermal induction, it is possible that the following problems will occur.

That is, an active steering system tilts the rollers around which the fixation belt is suspended by being stretched around them. Tilting the rollers alters the track of the fixation belt. Therefore, the employment of an active steering system makes it difficult to keep uniform the distance between the metallic layer of the fixation belt and the induction coil, in terms of the width direction of the fixation belt; the distance sometimes became nonuniform.

Therefore, this nonuniformity in the distance between the coil and belt in terms of the belt width direction renders the amount of heat generated in the fixation belt nonuniform in terms of the belt width direction.

SUMMARY OF THE INVENTION

Thus, the primary object of the present invention is to provide an image heating apparatus which is structured so that the deviation of the fixation belt is controlled by tilting the members around which the fixation belt is suspended, and which is characterized in that the distance between the coil and belt does not become nonuniform in spite of the changes in the angle of the belt suspending member.

Another object of the present invention is to provide an image heating apparatus which is structured to control the deviation of the fixation belt by tilting the belt suspending member, and which is characterized in that it can minimize the extent of the nonuniformity (in terms of width direction of fixation belt) in the heat generation in the fixation belt, which is attributable to the nonuniformity (in terms of width direction of fixation belt) in the distance between the coil and belt, which is attributable to the changes in the angle of the belt suspending member.

According to an aspect of the present invention, there is provided an image heating apparatus comprising an endless belt for heating an image on a recording material; a supporting member for supporting said belt; a coil for induction heat generation in said belt; control means for controlling a position of said belt in a widthwise direction by inclining said supporting member so as to maintain the position of said belt in the widthwise direction within a predetermined target range; and suppressing means for suppressing a variation of a distance between said belt and said coil with a variation of inclination of said supporting member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

First, a copying machine will be described as an example of an image processing apparatus, and then, a fixing apparatus will be described.

{Image Processing Apparatus}

Next, an image forming apparatus will be described.

Figure 1:
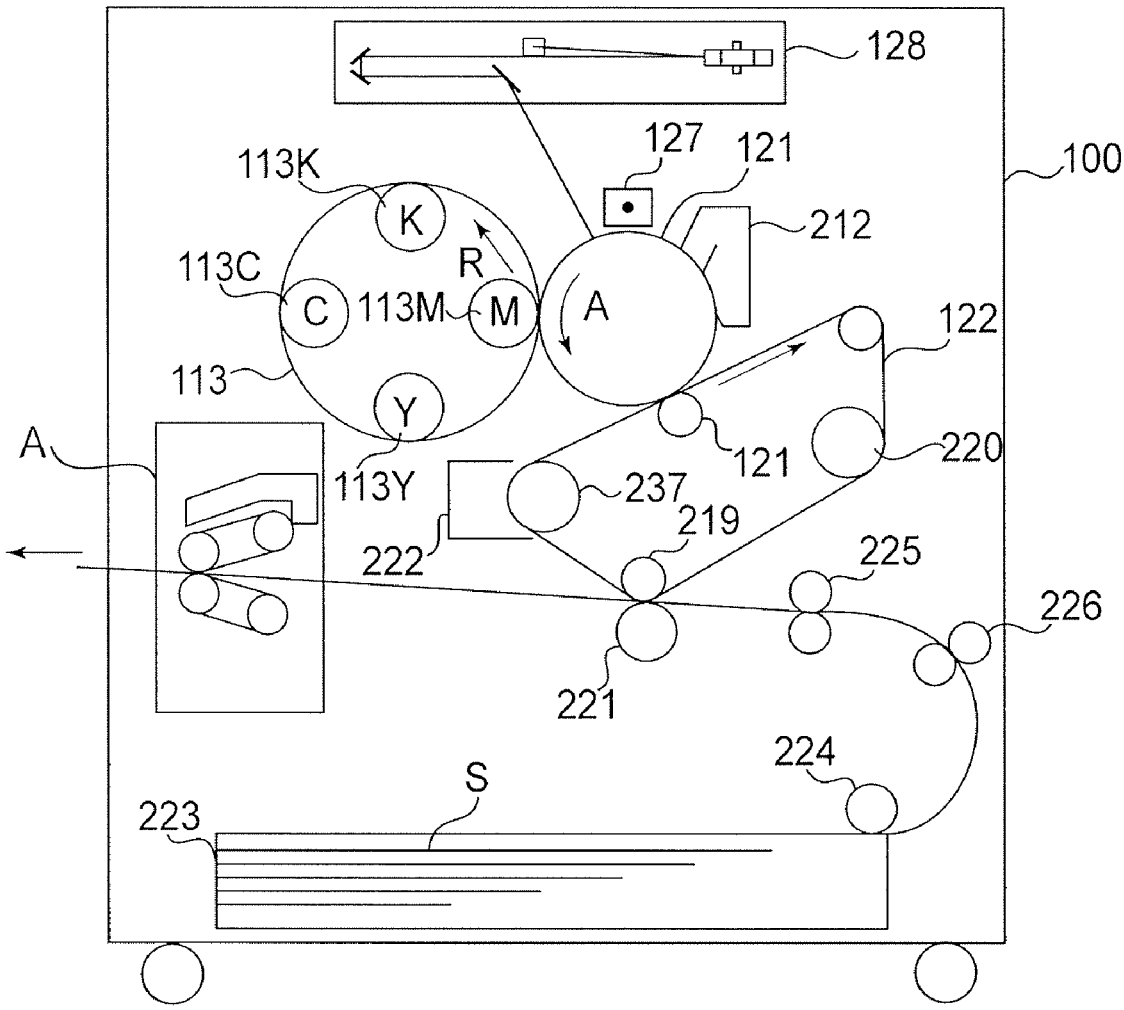
FIG. 1 is a sectional view of the fixing apparatus in the first preferred embodiment of the present invention.

FIG. 1 is a schematic drawing of an electrophotographic color printer in this embodiment, which is an example of an image forming apparatus. A sheet (unshown) is a medium on which a toner image is formed. Examples of the sheet of medium are a sheet of ordinary paper, a sheet of cardboard, a sheet of transparent film, an envelop, and the like.

The printer 100 in FIG. 1 is provided with four developing devices 113, which are for Y (yellow), M (magenta), C (cyan), and Bk (black) colors, one for one. The process used for forming a latent image which is to be developed by the developing device 113 is one of the ordinary electrophotographic processes. That is, a latent image is formed through the following steps: (1) a charging device 127 uniformly charges a photosensitive drum 121; (2) a laser scanner 128 forms a latent image on the peripheral surface of the photosensitive drum 121; (3) the latent image is developed by the developing device 113 into a toner image; (4) the toner image on the photosensitive drum 121 is transferred by a primary transferring device 121 onto an intermediary transfer belt 122, which is an image bearing member; and (5) three other toner images, different in color, are formed in layers on the intermediary transfer belt 122 through the abovementioned steps (1)-(4).

Meanwhile, the sheets S are sent out one by one from a sheet feeder cassette 223, and conveyed to a pair of registration rollers 225. If any of the sheets S is conveyed askew, it is corrected in attitude as its leading edge comes into contact with the pair of registration roller 225. The pair of registration rollers 225 releases each sheet S, conveying the sheet S to the interface between the intermediary transfer belt 122 and a secondary transfer roller 221, in synchronization with the movement of the toner image on the intermediary transfer belt 122. The color toner image on the intermediary transfer belt 122 is transferred onto the sheet S by the secondary transfer roller 221, which is a toner image transferring member. Thereafter, the toner image on the sheet S is subjected to heat and pressure in a fixing device A, being thereby fixed to the sheet S.

{Fixing Apparatus}

Embodiment 1

Figure 2:
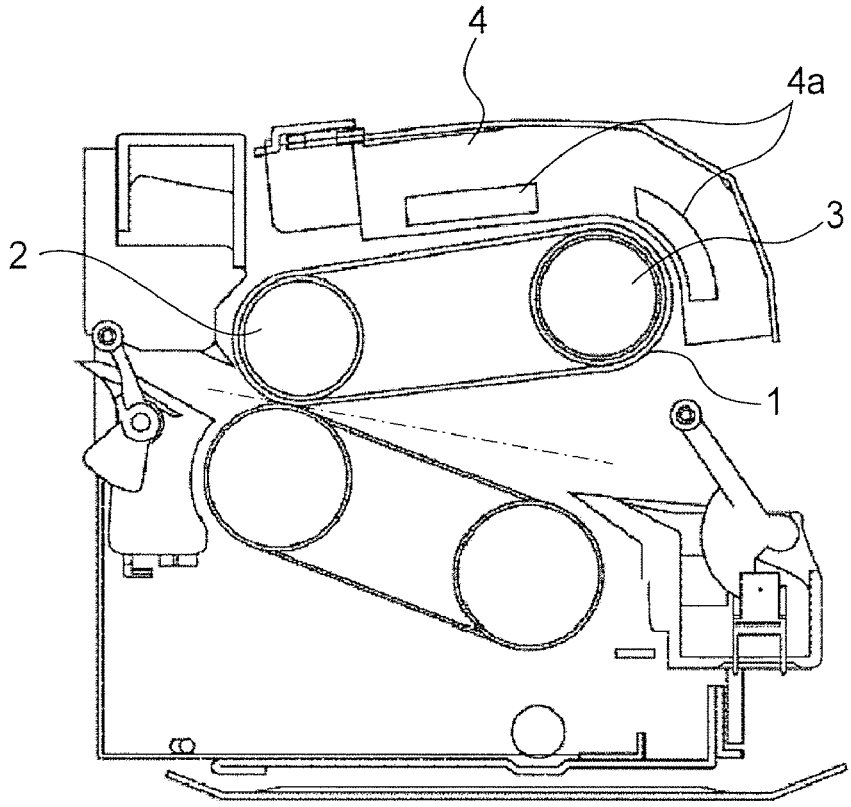
FIG. 2 is a sectional view of the fixing apparatus employed in the first preferred embodiment of the present invention.

FIG. 2 is a sectional view of the fixing apparatus, in this embodiment, which is an image heating apparatus.

The fixing apparatus is equipped with a fixation belt 1 (fixing means), which is an endless belt. The fixation belt 1 is made up of a 75 μm thick substrate layer formed of nickel, and a 300 μm thick elastic layer formed on the outward surface of the substrate layer, in terms of the loop which the fixation belt 1 forms.

As the material for the elastic layer, any of known elastic substances may be used, for example, silicone rubber and fluorinated rubber. In this embodiment, the elastic layer is formed of silicone rubber, and is 20 degrees in hardness (JIS-A), and 0.8 W/mK in thermal conductivity. The deformation of this elastic layer prevents the sheet S from wrapping around the fixation belt 1, ensuring that the sheet S separates from the fixation belt 1. The fixation belt 1 is also provided with a 30 μm thick surface layer formed of fluorinated resin (for example, PFA and PTFE). The surface layer functions as a sheet releasing layer.

The fixation belt 1 is stretched around a fixation roller 2 (which hereafter may be referred to as first belt suspending member) and a tension roller 3 (which hereafter may be referred to as second belt suspending member). The fixation belt 1 is rotationally driven by the fixation roller 2. The tension roller 3 is designed so that it is made to generate heat, by the function of the magnetic flux from a magnetic flux generating means disposed outside the tension roller 3.

The fixation roller 2 is an elastic roller, which is made up of a metallic core and an elastic layer. The metallic core is formed of iron alloy, and is 20 mm in external diameter and 18 mm in internal diameter. The elastic layer is formed of silicone rubber.

Providing the fixation roller 2 with the elastic layer enables the fixation roller 2 to frictionally drive the fixation belt 1; it enables the fixation roller 2 to efficiently transmit to the fixation belt 1 the driving force transmitted to the fixation roller 2 from an unshown driving force source (motor) through a gear train.

The silicone rubber, which is the material for the elastic layer of the fixation roller 2, is 15 degrees in hardness (JIS-A) and 0.8 W/mK in thermal conductivity. Providing the fixation roller 2 with the silicone rubber layer reduces the thermal conduction to the metallic core, being therefore effective to reduce the warm-up time.

Figure 7:
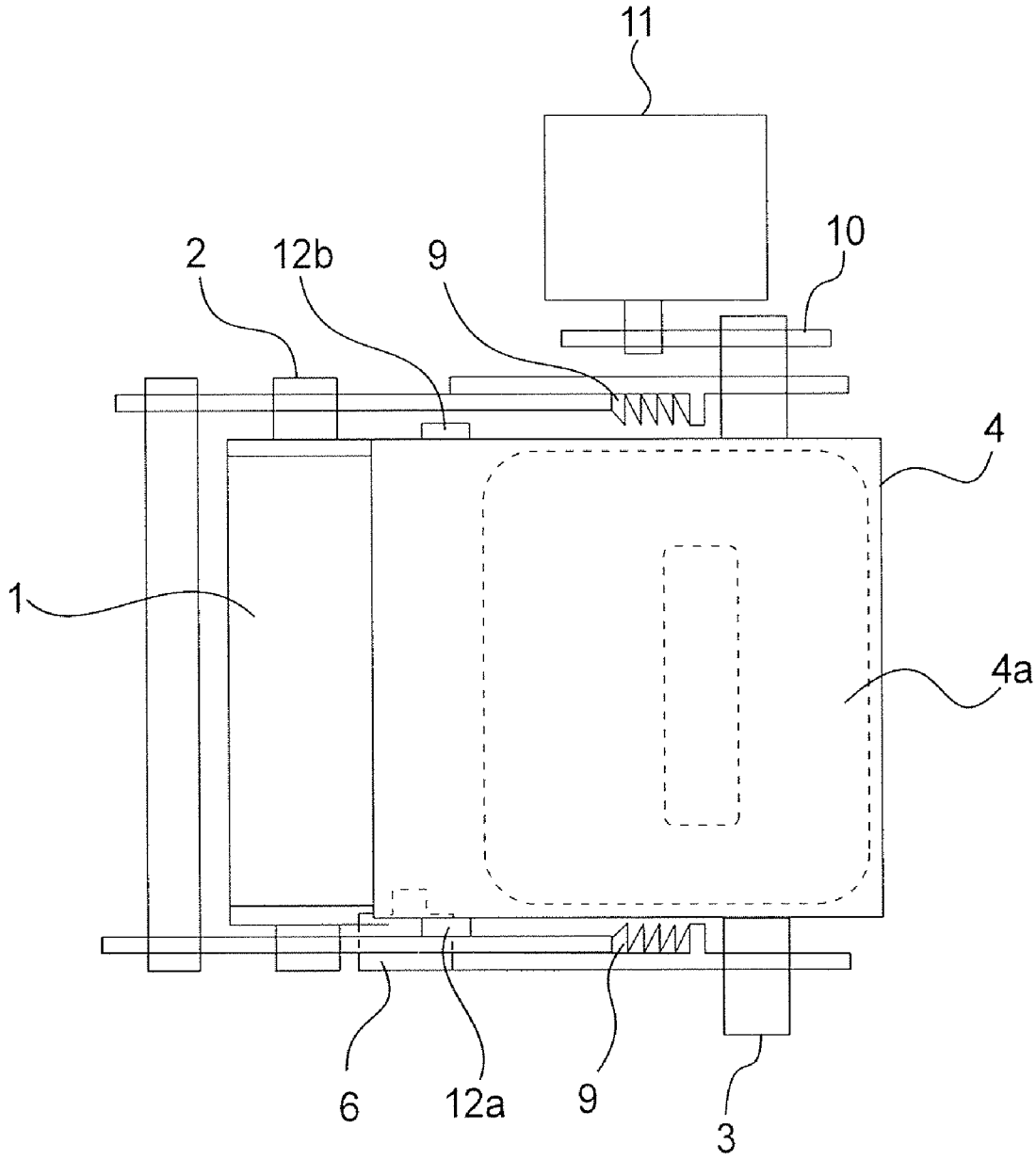
FIG. 7 is a schematic drawing (II) of the deviation control mechanism.

The tension roller 3 is a hollow iron roller, which is 20 mm in external diameter, 18 mm in internal diameter, and 1 mm in wall thickness. It is kept under the pressure applied to the pair of journals attached to its lengthwise ends, from a pair of springs 9, shown in FIG. 7. Not only does it function to suspend the fixation belt 1, but also, it is heated. Incidentally, the belt suspending member may be in the form of a roller or guide, as long as it can be moved in an oscillatory manner.

The heating assembly 4 has an excitation coil 4*a* which is a magnetic flux generating means, and a coil holder 4*c* (coil supporting dielectric member) which is a coil supporting member for supporting this coil 4*a*. It also has a stay 4*b*, which is not only for supporting the coil holder 4*c*, but also, for supporting the tension roller 3 (belt suspending member) at both of the journals located at the lengthwise ends of the tension roller 3, with the interposition of bearings.

The coil 4*a* is shaped so that its external contour matches the contour of the flat portion of the fixation belt 1 (endless belt) and the contour of the outward surface (in terms of fixation belt loop) of the belt portion which is in contact with the tension roller 3. The distance between the coil 4*a* and the flat portion of the fixation belt 1 is set to roughly 3.5 mm. The distance between the coil 4*a* and the curved portion of the fixation belt 1, that is, the portion of the fixation belt 1, by which the fixation belt 1 is suspended by the tension roller 3, is set to roughly 2.5 mm.

The coil holder 4*c* is disposed between the coil 4*a* and fixation belt 1. Therefore, it is required to withstand not only the heat which comes directly from the coil 4*a*, but also, the ambient temperature. Therefore, it is desired that a substance such as LCP (Liquid Crystalline Polymer) which is highly heat-resistant and stable in shape and size is used as the material for the coil holder 4*c*.

Figure 5:
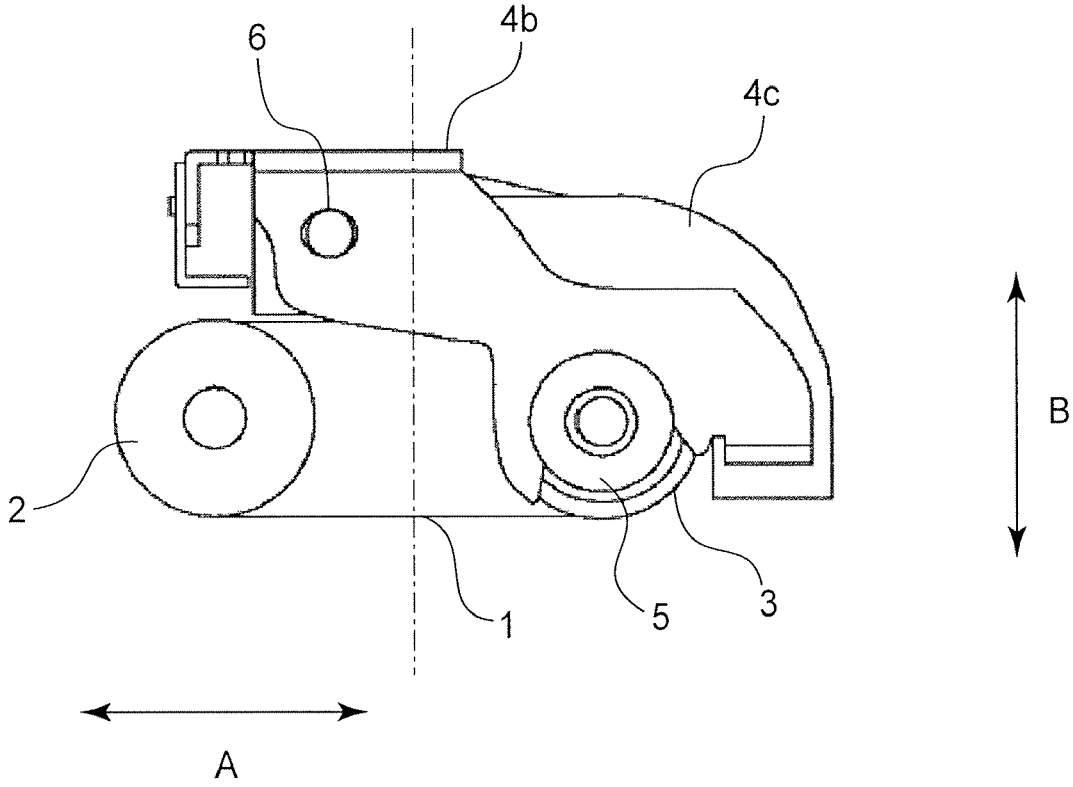
FIG. 5 is a drawing (II) showing the belt deviation controlling means in the first preferred embodiment of the present invention.

In this embodiment, a controlling means for preventing the distance between the coil 4*a* and fixation belt 1 from becoming nonuniform as the belt suspending member is changed in angle is employed. As such a means, the following means is employed. That is, the abovementioned controlling means in this embodiment has an engaging portion, which engages a pair of bearings with which the lengthwise ends of the tension roller 3 are provided one for one, and a positioning shaft 6 for properly positioning the heating assembly 4. Referring to FIG. 5, in this embodiment, the heating assembly 4 is held to the stay 4*b* at three points: the pair of bearings 5 for rotatably supporting the tension roller 3 by the journals located at the lengthwise ends of the tension roller 3 and the positioning shaft 6 (regulating member, regulating portion) extended from the front plate 7 of the fixing apparatus. Incidentally, the positioning shaft 6 may be formed as a part of the heating assembly 4. Not only does the positioning shaft 6 prevent the heating assembly 4 from rotating about the tension roller 3, but also, it prevents the distance between the heating assembly 4 and the flat portion of the fixation belt 1 from becoming nonuniform.

Each bearing 5 is fitted in the C-shaped recess of the stay 4*b*, the diameter of which perfectly matches the external diameter of the bearing 5. Therefore, the distance between the tension roller 3 and coil 4*a* is kept uniform regardless of the alignment (changes in angle of tension roller) of the tension roller 3. Further, the stay 4*b* is supported by the tension roller 3, with the bearings 5 disposed between the stay 4*b* and tension roller 3. Therefore, the stay 4*b* is small in the amount of frictional resistance it generates as it is moved.

The positioning shaft 6 is attached to the stationary end of the tension roller 3 (end that is not moved by deviation control mechanism). That is, the oscillatory lengthwise end of the tension roller 3, and the edge of the flat portion of the heating assembly 4, which is on the unsupported side of the heating assembly 4, are located on the same side, realizing thereby a structure that prevents the tension roller 3 from rotating about the diagonal line that connects the nonoscillatory lengthwise end of the tension roller and the positional shaft 6, in order to make it easier for the heating assembly 4 to follow the movement of the fixation belt 1. If the positioning shaft 6 is located on the same side as the oscillatory lengthwise end of the tension roller 3, the heating assembly 4 is allowed to rotate about the diagonal line that connects the nonoscillatory lengthwise end of the tension roller 3 and the positioning shaft 6, making it difficult for the coil unit to follow the fixation belt 1.

The positioning shaft 6 is located between the fixation roller 2 and tension roller 3 so that the distance between the axial line of the tension roller 3 and the axial line of the positioning shaft 6 is no less than << of the distance between the axial line of the fixation roller 2 and the axial line of the tension roller 3. Therefore, the movement of the edge of the flat portion of the heating assembly 4, which occurs on the nonoscillatory side of the tension roller 3, is no more than ½ of the amount by which the tension roller 3 is moved by the belt deviation control in the direction (B), which is roughly perpendicular to the direction (A) in which the fixation belt 2 is stretched to provide the fixation belt 2 with tension.

The heating assembly 4 is supported by the positioning shaft 6; the positioning shaft 6 is fitted in the elongated hole of the heating assembly 4, the major axis of which is roughly parallel to the moving direction of the fixation belt 1. This set-up absorbs the fluctuation in the distance between the axial line of the tension roller 3 and the axial line of the positioning shaft 6, which occurs as the tension roller 3 is vertically moved to control the belt deviation. It is desired that the major axis of the elongated hole is parallel to the neutral line of the oscillatory range (angle) for the belt deviation control (line which is perpendicular to axial line of the tension roller 3 and axial line of fixation roller 1 when tension roller 3 and fixation roller 2 are parallel to each other, that is, when they are in their home position).

Further, it is preferable that the fixing apparatus is structured so that the positioning shaft 6 is borne by the fixation roller 2 itself, or is positioned so that the axial line of the positioning shaft 6 coincides with the axial line of the fixation roller 2. With the employment of this structural arrangement, as the tension roller 3 is moved in an oscillatory manner to control the belt deviation, both the heating assembly 4 and fixation belt 1 pivot about the axial line of the fixation roller 2. Therefore, the distance between the heating assembly 4 and fixation belt 1 remains uniform.

Figure 6:
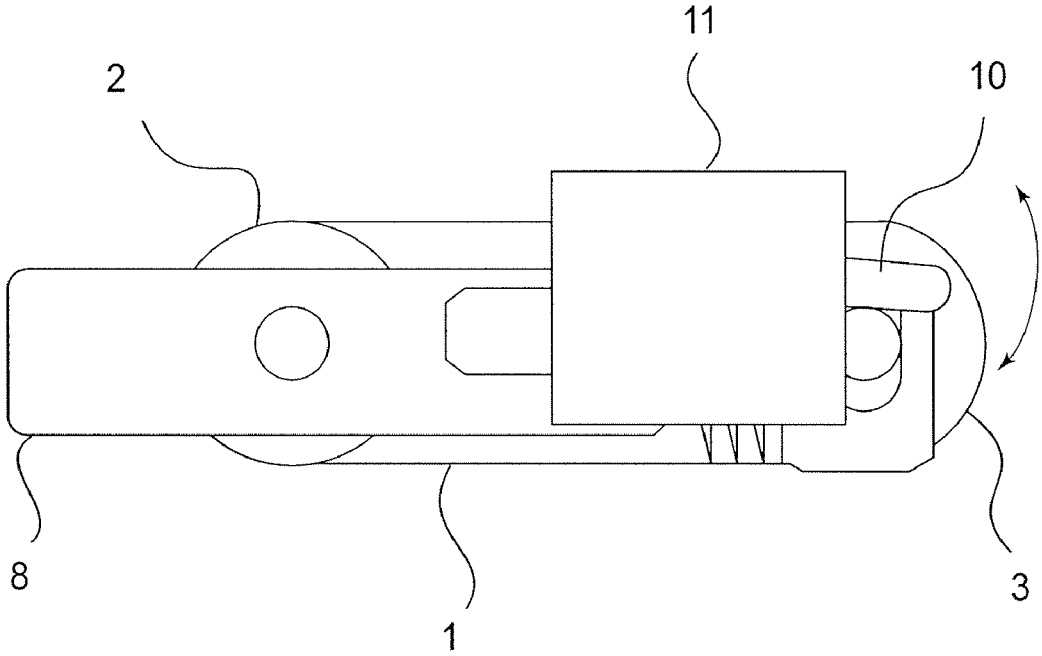
FIG. 6 is a schematic drawing (I) of the deviation control mechanism.

FIG. 6 shows the controlling means (deviation controlling means) for controlling the position of the fixation belt 1, in terms of the width direction of the fixation belt 1, so that the position of the fixation belt 1 remains within a preset range in terms of the width direction of the fixation belt 1.

The deviation controlling means has a control arm 10 for vertically moving the tension roller 3, and a pulse motor 11 which is a driving force source for rotating the deviation control arm 10. As the belt deviation is detected by a pair of deviation detecting means 12 shown in FIG. 7, the pulse motor 11 is rotated by a preset value. The deviation detecting means 12 may be a combination of a spring-loaded rotational flag and a sensor of the transmission type, for example.

Figure 3:
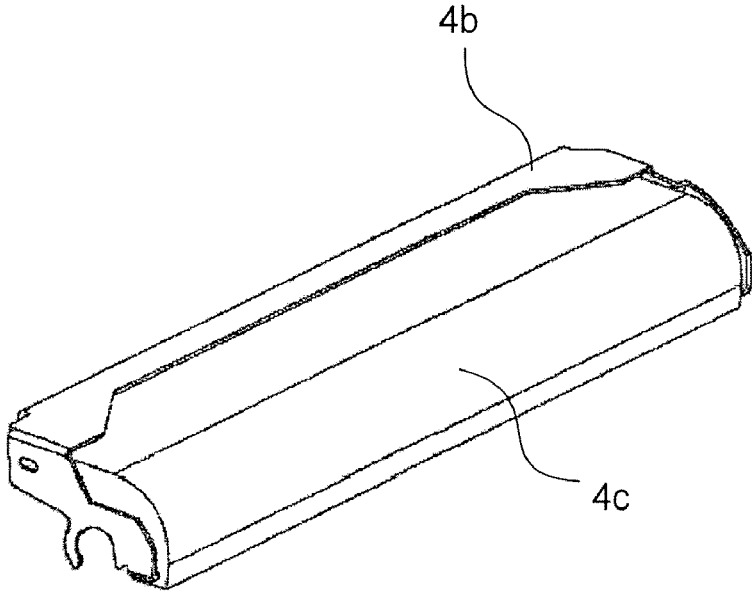
FIG. 3 is a perspective view of the heating assembly employed in the first embodiment of the present invention.
Figure 4:
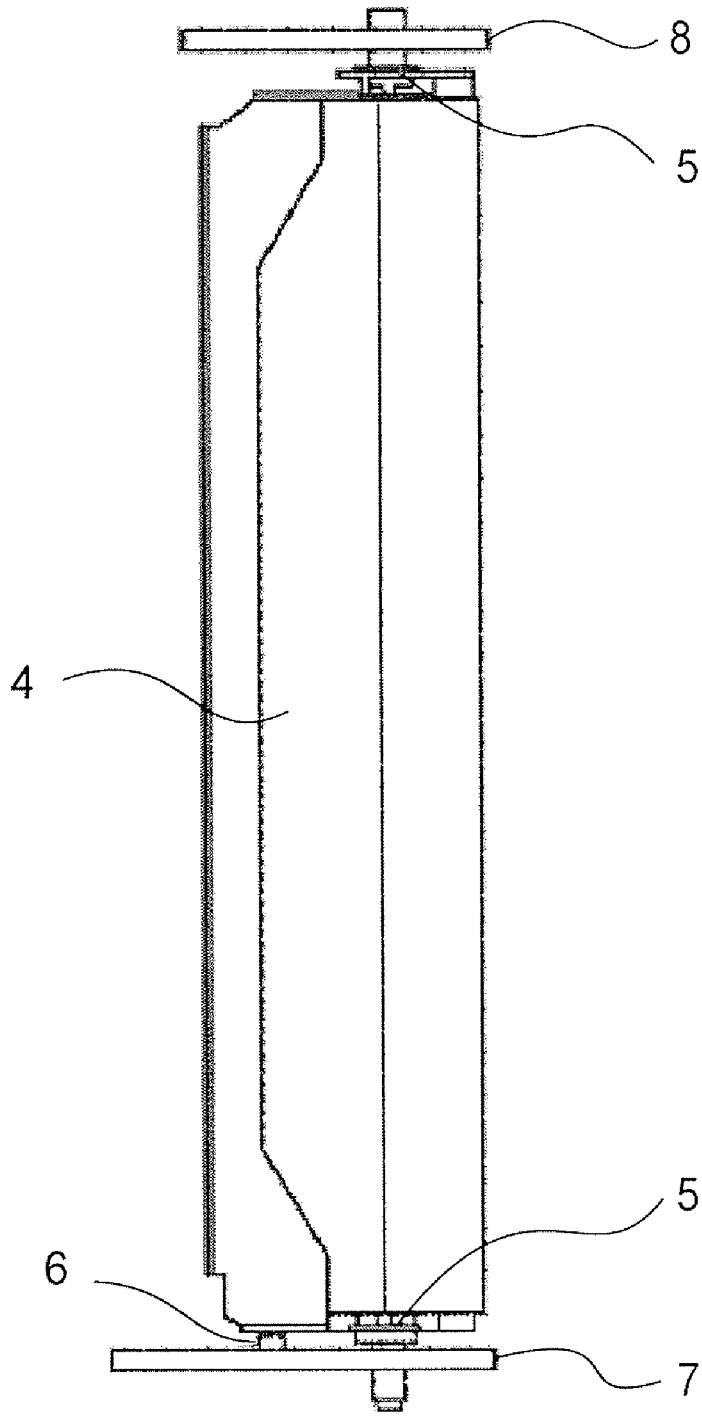
FIG. 4 is a drawing (I) showing the belt deviation controlling means in the first preferred embodiment of the present invention.
Figure 8:
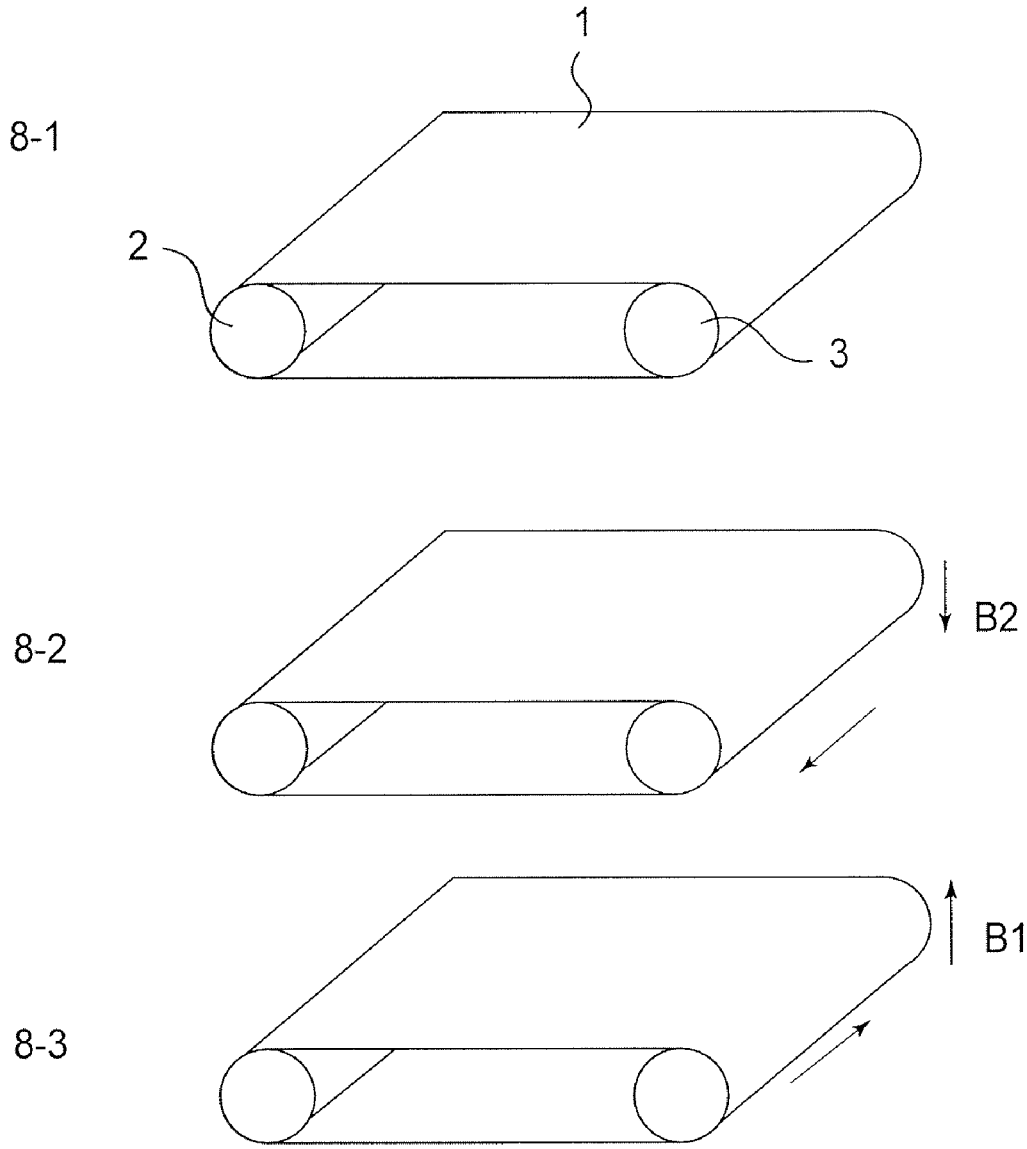
FIG. 8 is an illustration of the deviation control mechanism.

As the deviation detecting means 12*b*, which is on the rear side, detects the belt deviation, the deviation controlling means moves the tension roller 3 downward (direction B2) (FIGS. 8-2), whereas as the deviation detecting means 12*a*, which is on the front side, detects the belt deviation, the deviation controlling means moves the tension roller 3 upward (direction B1) (FIGS. 8-3).

The above described operations are repeated to control the belt deviation to prevent the edges of the fixation belt 1 from coming into contact with the other components. The amount by which the tension roller 3 is to be moved is set to a value which is within a range in which the performance of the fixing apparatus is not affected by the movement of the tension roller 3. The belt deviation control generates such a force that works in a manner to twist the fixation belt 1, subjecting thereby the fixation belt 1 to this force. Therefore, in consideration of the durability of the fixation belt 1, a value which is as small as possible in the range in which the fixing apparatus is not reduced in fixation performance is selected for the amount by which the tension roller 3 is to be moved to control the belt deviation. In this embodiment, the amount by which the tension roller 3 is to be moved was set to ±0.5 mm.

Embodiment 2

The structure of the fixing apparatus in this embodiment is the same as that in the first embodiment. Therefore, only the portions of the fixing apparatus, which are different from those in the first embodiment will be described next.

In the first embodiment, a direct measure was taken; the heating assembly 4 was attached to the tension roller 3, with the bearings disposed between the heating assembly 4 and tension roller 3. In this embodiment, however, it is proposed to take an indirect measure; a member which remains in contact with the heating assembly 4 and the surface of the fixation belt 1, in the range in which the tension roller 3 is in contact with the fixation belt 1, is provided as an indirect means for regulating the distance between the heating assembly 4 and an object to be heated. For example, the fixing apparatus may be provided with a rotation member which is placed between the heating assembly 4 and fixation belt 1 to keep uniform the distance between the heating assembly 4 and fixation belt 1, and a means for keeping the heating assembly 4 pressed toward the axial line of the tension roller 3. With the employment of this structural arrangement, it is possible to make the heating assembly 4 follow the oscillatory movement of the tension roller 3.

However, the fixing apparatus in the second embodiment may damage the image fixing surface of the fixation belt 1. Therefore, it is desired that the abovementioned member, which is placed in contact with the fixation belt 1 to regulate the distance between the heating assembly 4 and fixation belt 1, is placed in contact with the area of the image fixing surface of the fixation belt 1, which will be outside the image formation area of the sheet of recording medium with which the image fixing surface comes into contact.

[Miscellanies]

Not only can the image heating apparatus in accordance with the present invention be used as a fixing apparatus such as those in the preceding preferred embodiments, but also, it can be effectively used as a temporary fixing apparatus for temporarily fixing an unfixed image to recording medium, which is an object to be heated, and a surface property altering apparatus for altering the surface properties, such as glossiness, of an fixed image on recording medium by reheating the recording medium, which is the object to heated.

[Effects of the Invention]

The present invention makes it possible for the coil to follow the movement of an object to be heated, making it thereby possible to keep uniform the distance between the coil and belt. Therefore, it is possible to keep the belt uniform in heat distribution in terms of the width direction of the belt, making it thereby possible to uniformly heat an unfixed image. Therefore, it is possible to obtain images which are satisfactory in that they do not suffer from the nonuniformity in fixation and the nonuniformity in glossiness.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 265511/2005 filed Sep. 13, 2005 filed which is hereby incorporated by reference.

What is claimed is:

1. An image heating apparatus comprising:

an endless belt for heating an image on a recording material;

a supporting member for supporting said belt;

a coil for induction heat generation in said belt;

control means for controlling a position of said belt in a widthwise direction by inclining said supporting member so as to maintain the position of said belt in the widthwise direction within a predetermined target range; and suppressing means for suppressing a variation of a distance between said belt and said coil with a variation of inclination of said supporting member.

2. An apparatus according to claim 1, further comprising a coil supporting member for supporting said coil, said coil supporting member being supported at each of opposite ends of said supporting member, wherein said coil supporting member is provided with a regulating portion for regulating movement of said coil supporting member in a circumferential direction of said supporting member.

3. An apparatus according to claim 2, wherein said changing means changes the position of said belt by moving, about one end side of a rotation shaft of said supporting member, the other end side thereof, and wherein said regulating portion limits movement of said coil supporting member at said one side thereof.

4. An apparatus according to claim 1, wherein said changing means moves said supporting member substantially perpendicularly to a direction of tension applied to said belt.

5. An image heating apparatus comprising:

an endless belt for heating an image on a recording material;

a supporting member for supporting said belt;

a coil for induction heat generation in said belt;

a coil supporting member for supporting said coil;

control means for controlling a position of said belt in a widthwise direction by inclining said supporting member so as to maintain the position of said belt in the widthwise direction within a predetermined target range; and a regulating portion for regulating a position of said coil supporting member such that coil supporting member is concentric with a center of rotation of said supporting member.

* * * * *

UNITED STATES PATENT AND TRADEMARK OFFICE

CERTIFICATE OF CORRECTION

PATENT NO. : 7,424,261 B2
APPLICATION NO. : 11/470456
DATED : September 9, 2008
INVENTOR(S) : Uchida et al.

It is certified that error appears in the above-identified patent and that said Letters Patent is hereby corrected as shown below:

COLUMN 6:
Line 43, "(FIGS. 8-2)," should read --(FIG. 8-2),--.
Line 46, "(FIGS. 8-3)." should read --(FIG. 8-3).--.

COLUMN 8:
Line 5, "filed" (second occurrence) should be deleted.

Signed and Sealed this

Third Day of February, 2009

JOHN DOLL
*Acting Director of the United States Patent and Trademark Office*